US006712662B2

(12) United States Patent
Arnaud

(10) Patent No.: US 6,712,662 B2
(45) Date of Patent: Mar. 30, 2004

(54) TOOL FOR PLACING SPACERS IN A FLAT DISPLAY SCREEN

(75) Inventor: Bernard Arnaud, Montpellier (FR)

(73) Assignee: Pixtech S.A., Rousset (FR)

( * ) Notice: Subject to any disclaimer, the term of this patent is extended or adjusted under 35 U.S.C. 154(b) by 27 days.

(21) Appl. No.: 09/866,966

(22) Filed: May 29, 2001

(65) Prior Publication Data

US 2002/0016125 A1 Feb. 7, 2002

(30) Foreign Application Priority Data

May 30, 2000 (FR) ..... 00 06922

(51) Int. Cl.[7] ..... H01J 9/24

(52) U.S. Cl. ..... 445/24; 445/22; 445/23; 445/25; 445/26

(58) Field of Search ..... 445/24, 25, 43, 445/23, 66; 313/495, 292, 288, 456, 250, 461, 422; 315/169.1, 12.1

(56) References Cited

U.S. PATENT DOCUMENTS 5,697,825 A * 12/1997 Dynka et al.
5,820,434 A * 10/1998 Itoh et al.
5,921,837 A * 7/1999 Kanagawa et al.
6,066,915 A * 5/2000 Pepi
6,146,228 A * 11/2000 Mougin et al.

FOREIGN PATENT DOCUMENTS

FR 2 728 385 12/1995
FR 2 749 105 5/1997

* cited by examiner

*Primary Examiner*—Dean A. Reichard
*Assistant Examiner*—Nguyen T. Ha
(74) *Attorney, Agent, or Firm*—Duane Morris LLP

(57) ABSTRACT

A tool and a method for positioning spacers on a first plate intended for being maintained at a distance from a second plate by said spacers, said tool including openings for receiving said spacers, and said openings being of variable size between a first position of introduction of the spacers and a second position of mechanical blocking of the spacers.

15 Claims, 6 Drawing Sheets

TOOL FOR PLACING SPACERS IN A FLAT DISPLAY SCREEN

BACKGROUND OF THE INVENTION

1. Field of the Invention

The present invention relates to flat display screens. The present invention more specifically applies to screens provided with an internal space (generally under vacuum) isolated from the outside and defined by the spacing between two plates respectively forming the screen bottom and surface.

2. Discussion of the Related Art

Conventionally, a flat screen of the type to which the present invention relates is formed of two generally rectangular spaced apart external plates, for example made of glass. One plate forms the screen surface while the other one forms the screen bottom generally provided with emission means. The two plates are assembled by means of a peripheral seal. For a field-effect screen (FED), or a screen with microtips, or for a vacuum fluorescent display (VFD), vacuum is created in the space separating the two glass plates. In other cases, this space contains a neutral atmosphere (rare gas).

FIG. 1 schematically shows in a cross-section view, the conventional structure of an example of a flat screen of the type to which the present invention relates.

Such a screen is essentially formed, on a first substrate 1, for example made of glass, of an electron bombarding cathode and of one or several grids. In FIG. 1, the cathode/grid(s) assembly is designated by common reference 2. This cathode/grid(s) is placed opposite to a cathodoluminescent anode 3 formed on a second substrate 4, for example made of glass, which is transparent if it forms the screen surface.

An example of a flat screen of the type to which the present invention applies is a microtip screen described, for example, in U.S. Pat. No. 4,940,916 of the Commissariat à l'Energie Atomique.

Cathode/grid(s) 2 and anode 3 are separately formed on the two substrates or plates 1 and 4, which are then assembled by means of a peripheral seal 5. An empty space 6 is created between plates 1 and 4 to enable circulation of the electrons emitted by the cathode to the anode. This space is, in what is designated as its thickness, defined by means of spacers 7 of calibrated height.

The spacers of definition of the inter-electrode space may be formed in several ways.

A first known technique consists of using calibrated balls regularly distributed on one of the plates, the diameter of the used balls (for example, of a given value included between 100 micrometers and 2 millimeters) defines the height of the inter-electrode space. An example of a method for positioning such spherical spacers is described in European patent application No. 0,867,912 of the applicant.

Another known technique for the forming of spacers of definition of the inter-electrode space of a flat screen is to use non-spherical spacers having the shape of posts. These may be sections of cylinders or of posts of various cross-sections (square, rectangular, cross-shaped or others). The use of non-spherical elements is often preferred since it enables minimizing the areas forming obstacles against electron travel between the screen cathode and anode.

The present invention more specifically relates to the placing of non-spherical spacers.

An example of a method for assembling plates of a flat display screen using this type of spacers is described in French patent application No. 2,749,105.

Spacers of non-spherical type are generally positioned and maintained, before fastening (gluing or others), on one of the screen plates, in a grid of small thickness (for example, on the order of from 70 to 90 micrometers). Given its small thickness, such a grid is only proper for spacers of relatively small height (in practice, on the order of 200 micrometers), but no longer enables correct pre-positioning before fastening for spacers of greater height (beyond 400 micrometers). Now, the spacer height that defines the thickness of the inter-electrode space conditions the operating voltage of the flat screen. The higher the desired operating voltage, the thicker the inter-electrode space and the higher the spacers must be.

The grids of positioning and temporary hold of the spacers are generally formed by photoetching techniques, either by electroplating of metal, or to etch a full-plate deposited metal layer, or by etching the very grid.

In the case where the spacers to be positioned have a height greater than 400 micrometers, several layers, generally metallic, must conventionally be superposed.

FIG. 2 illustrates, in a simplified cross-section view, what resembles a superposition of positioning grids. The left-hand portion of FIG. 2 illustrates the superposition of two grids obtained by successive etching of layers 12 deposited full plate, while the right-hand portion of FIG. 2 illustrates the superposition of two grids formed by successive electroplating of pads 11. It should be noted that the superposition of the two grids does not correspond to bringing two grids formed separately one onto the other but to successively performing, on a same substrate (not shown), two electroplating or etching steps.

Whatever the used technique, a mask of definition of openings 10 for positioning spacers 7 or defining pads 11 between the holes distributed in the mask, is used. The mask forming generally uses the deposition of a resist layer. This layer is formed over a thickness generally ranging between 70 and 90 microns. This resist is insolated by means of a lithography mask. Then, the resist is developed by a negative or positive etching according to whether the etching of holes 10 (left-hand portion of FIG. 2) is desired to be obtained or metal (for example, nickel) is desired to be grown around resist pads at the locations of the future holes 10 (right-hand portion of FIG. 2).

A first problem which arises has to do with the thickness desired for the grid. Indeed, with such a thickness, it is not possible to obtain an exposure enabling obtaining an isotropic etching of the holes or of the pads in the resist. Accordingly, as illustrated in FIG. 2, the etching or electroplating is necessarily performed anisotropically and a minimum diameter of holes 10 corresponding to a diameter greater than the diameter (or than the diameter in which the section is inscribed) of spacers 7 must then be provided. For example, for spacers having a cross-section diameter of approximately 50 microns, a minimum diameter of holes 10 on the order of 60 microns must be provided. As a result, the maximum diameter of holes 10 is much greater.

In the case of an electroplating illustrated by the right-hand portion of FIG. 2, the successive layer depositions inevitably come along with an increase of the diameter of holes 10. In the case illustrated in the left-hand portion of FIG. 2, which shows an alternation of steps of full plate deposition of a selectively etchable material 12 and of etching of this material by means of a same exposure mask, the involved thickness inevitably results in anisotropic edges for holes 10.

A first consequence is that the positioning of spacers 7 in the obtained grid has strong risks of occurring incorrectly.

FIGS. 3A and 3B illustrate, in simplified cross-section views of a tool for positioning spacers, an example of implementation of a conventional method for positioning and applying spacers on a flat screen plate.

As illustrated in FIG. 3A, the obtained pre-positioning grid 15 and 15' (FIG. 2) is laid on a porous or perforated plate 20 of a vacuum table or the like. Plate 20 is generally formed of a porous support of metal or another adapted material (ceramic, etc.). Space 22 underlying plate 20 is closed by an enclosure 21 partially shown and this space 22 communicates with a pumping opening 23 connected to a vacuum pump (not shown). The suction caused by the pump on plate 20 is transmitted by holes 10. In a simplified embodiment, a significant volume of spacers 7 is just roughly distributed on the surface of pre-positioning grid 15 or 15', after which the vacuum pump is operated so that a spacer 7 is retained in each hole 10 after having entered therein by suction. The excess spacers can then be eliminated, for example, by turning the tool upside down above a recovery tank, or by sweeping, blowing, vibration, inclined plane, etc.

As illustrated in FIG. 3A, in the case of a grid 15 manufactured by electroplating, there is a non-negligible risk of seeing some spacers be placed completely slantwise in holes 10. This phenomenon is not as strong in the case of a grid 15' obtained by full plate deposition and etching of different layers but however remains, mainly due to the difficulty of perfectly aligning the mask upon insolation prior to the etching of the different levels. The hole of a higher level will generally have a diameter greater than that of a hole of lower level, or shifted with respect thereto.

Once the spacers are individually maintained in the respective holes 10 of the pre-positioning grids, a plate coated with glue is brought onto the free ends of spacers 7 so that a thin layer of glue 16 deposits thereon. Finally, as illustrated in FIG. 3B, the screen plate (for example, 1) on which the spacers are desired to be glued is brought and applied on the free ends, now sticky, of spacers 7 which are thus maintained thereon. Once the fastening has been performed, the vacuum is cut-off in the vacuum table, which frees the spacers from the pre-positioning grids.

The rest of the flat screen assembly method is perfectly conventional and will not be detailed herein. It should only be reminded that the second screen plate (for example, 4) is added to be parallel to the first one with an interposed peripheral seal 5 as illustrated in FIG. 1.

Another problem that is posed in the positioning of the spacers on a screen plate is, independently from height problems, linked to the indispensable tolerances to be provided between the diameter of the positioning grid holes and the cross-section diameter of the spacers. Indeed, a rigorously adapted diameter cannot be provided. Now, to limit the obstacles to the electron travel between the cathode and the anode, as exact a positioning of the spacers on areas of no electron emission as possible must be searched. In practice, it is desired to arrange these spacers between the screen pixels generally defined by the intersection between cathode columns and lines of the associated extraction grid.

Above-mentioned French patent application NO. 2,749,105 provides different solutions of pre-positioning grid superposition to attempt reducing the above disadvantages. According to a solution of this document, it is provided to interpose a thick grid (210 micrometers) between two relatively thin grids (70 micrometers) which are made with more precision than this thick grid. However, the non-isotropic character of the holes in the external layers of the grid is nevertheless present due to the thickness of this grid. Further, this solution does not solve the necessary tolerance problem linked to the introduction of the spacers into the holes, which adversely affects the accurate positioning of these spacers on the screen plate.

SUMMARY OF THE INVENTION

The present invention aims at overcoming the disadvantages of known solutions for spacer pre-positioning grids between two screen plates to be assembled.

The present invention more specifically aims at providing a novel tool enabling avoiding all risks of spacer inclination upon installation.

The present invention also aims at providing a solution which optimizes the alignment of the free ends of the different spacers.

The present invention also aims at providing a novel spacer placing method which improves the positioning accuracy of these spacers on the screen plate. On this regard, the present invention also aims at providing a tool adapted to such a method.

The present invention further aims at easing the handling of the spacer positioning tool.

To achieve these objects, the present invention provides a tool for positioning spacers on a first plate intended for being maintained at a distance from a second plate by said spacers, said tool including openings for receiving said spacers, and said openings being of variable size between a first position of introduction of the spacers and a second position of mechanical blocking of the spacers.

According to an embodiment of the present invention, the general thickness of the positioning tool is smaller than one third of the height of the spacers.

According to an embodiment of the present invention, said openings have, in the first position, a diameter greater than the diameter in which the section of a spacer is inscribed, smaller than the height of the spacer and such that two spacers cannot be introduced therein at the same time.

According to an embodiment of the present invention, the positioning tool includes at least two grids in planes parallel to each other, at least one first grid being assembled to slide parallel to a second grid.

According to an embodiment of the present invention, the positioning tool includes two external grids attached in planes parallel to each other to define the distribution of the spacers, and at least one grid for locking the spacers in their position, slidably assembled between said two external grids.

According to an embodiment of the present invention, said two external grids include holes having a diameter substantially greater than the diameter in which the section of the spacers to be positioned is inscribed.

According to an embodiment of the present invention, said two external grids include holes of same diameter.

According to an embodiment of the present invention, said locking grid includes holes having a diameter at least equal to the diameter of the holes of the external grids.

According to an embodiment of the present invention, the thickness of the external grids is chosen according to the maximum tolerance desired for the positioning of the spacers.

According to an embodiment of the present invention, the thickness of the external grids is smaller than 50 micrometers.

According to an embodiment of the present invention, the holes of at least one locking grid are each associated with a resilient tab for blocking a spacer in its position.

According to an embodiment of the present invention, the holes of at least one of the external grids each include a notch for receiving one end of an arm of a spacer, said spacers having, in cross-section, the shape of a cross.

According to an embodiment of the present invention, the positioning tool includes at least one ductile grid provided with holes at least at the locations of the spacers, a change of size of said holes being caused by a controlled reversible deformation of this grid.

According to an embodiment of the present invention, the positioning tool includes at least one rigid grid parallel to the ductile grid and provided with holes approximately aligned with those of the ductile grid when said grid is in a first position.

The present invention also provides a spacer positioning method, consisting of using a vacuum table for placing a spacer in each opening of the positioning tool in a first position, then performing successive suction and blowing cycles, by applying a free end of the spacers against an alignment plate, before their locking in their position by narrowing of the openings.

The foregoing objects, features and advantages of the present invention will be discussed in detail in the following non-limiting description of specific embodiments in connection with the accompanying drawings.

DETAILED DESCRIPTION

Figure 1:
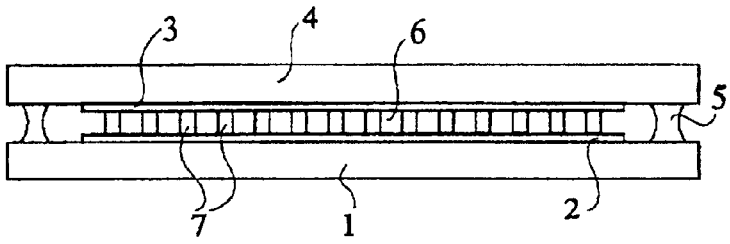
FIG. 1, previously described, is a very simplified cross-section view of a conventional example of an assembled flat screen of the type to which the present invention applies.
Figure 2:
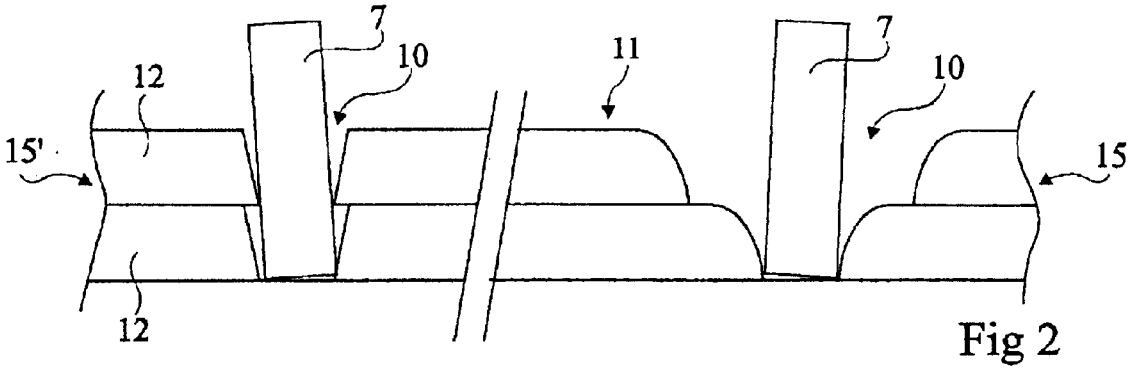
FIG. 2, previously described, is a partial cross-section view illustrating two conventional examples of spacer positioning tools.

Same elements have been designated with the same references in the different drawings. For clarity, the representations of the drawings are not to scale and only those elements that are necessary to the understanding of the present invention have been shown in the drawings and will be described hereafter. In particular, the details constitutive of the electrodes of the flat screen to which the present invention applies have not been discussed and are no object of the present invention. Similarly, only those steps of the flat display screen assembly method which are linked to the spacer positioning will be described hereafter, the rest of the assembly process being conventional.

A feature of the present invention is to provide a positioning tool able to temporarily blocking spacers in their position. According to the present invention, the positioning tool includes openings of variable size between a position of spacer introduction and a position of temporary blocking of these spacers.

Another feature of a positioning tool according to the present invention is that it includes at least one grid for mechanically blocking the spacers in their position. This grid can operate either alone, or in cooperation with one or several other grids of the positioning tool.

The present invention will first be described in relation with a first aspect that provides slidable assembly of an intermediary grid between two parallel external grids. According to this first aspect, the two external grids are formed accurately and are thus, preferably, of small thickness. According to this first aspect of the present invention, the central grid which is used as an element for locking or temporarily mechanically blocking the spacer position may, if necessary, be thicker and provided with holes possibly formed with less accuracy.

Figure 4:
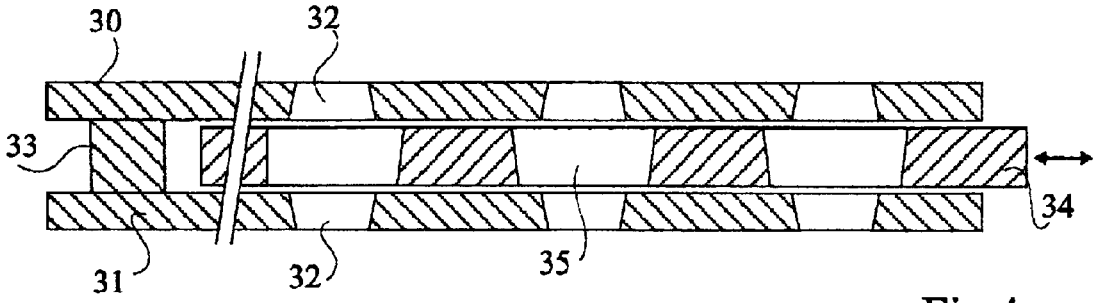
FIG. 4 shows, in a very simplified partial cross-section view, a first embodiment of a spacer positioning tool according to the present invention.

FIG. 4 shows in a simplified partial cross-section view a first embodiment of a spacer positioning tool according to the first aspect of the present invention. In the embodiment illustrated in FIG. 4, two external grids 30 and 31 are formed with holes 32 at the desired spacer positioning locations (not shown in FIG. 4). Grids 30 and 31 are, preferably, identical and are attached one on the other with interposed calibrated bracings 33. Bracings 33 define the interval between grids 30 and 31 in which is slidably assembled an intermediary grid 34 according to the present invention. The fastening of grids 30 and 31 together may be performed by any known means, for example, by riveting or spot welding on bracings 33. Intermediary grid 34 includes holes 35 having a diameter at least equal to holes 32 of grids 30 and 31. Grid 34 is, if necessary, thicker than grids 30 and 31. The thickness of grid 34 is, for example, chosen according to the spacer height.

It should however be noted that a first advantage of the present invention is that the general height of the positioning tool is not critical with respect to the spacer height since, as will be seen hereafter, the spacers are mechanically blocked in the positioning tool of the present invention. This advantage will be found in all the embodiments which will be described hereafter.

According to the present invention, the fact that the holes in the grids are not isotropic no longer matters. The only accuracy constraint to be respected is the regular distribution (the pitch) of holes 32 in grids 30 and 31 according to the respective positions desired for the spacers. Such an accuracy, as well as the accuracy in the alignment of grids 30 and 31 upon fastening, is perfectly compatible with the small thicknesses with which these grids can now be formed. For example, grids 30 and 31 having thicknesses on the order of from 20 to 50 micrometers are sufficient.

Holes 32 in grids 30 and 31 are, preferably, sized to be much greater than the cross-section diameter of the spacers to be positioned. Thus, the placing of the spacers in the positioning tool is made easier. Further, the spacer extraction in the final operation of gluing on one of the screen plates is made easier while, with a conventional system, the narrowness of the holes necessary for the accuracy risks blocking the spacers in the positioning grid. Of course, the diameter of holes 32 must remain smaller than the height of the spacers to be positioned so that they are introduced in the right direction in the positioning tool. Further, the diameter of holes 32 must enable introduction of a single spacer per hole.

Figure 5A:
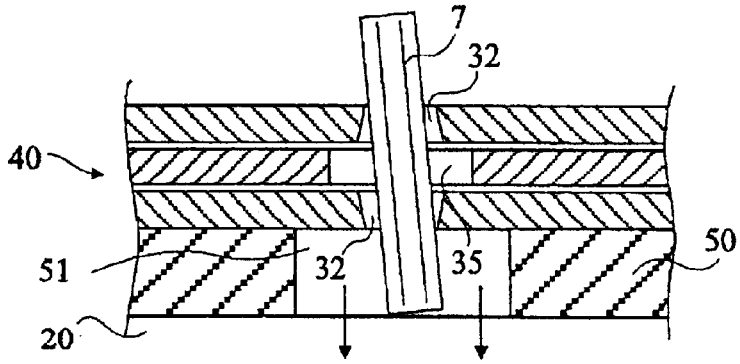
FIGS. 5A and 5B schematically illustrate in partial cross-section views a mode of implementation of a spacer positioning method according to the present invention.
Figure 5B:
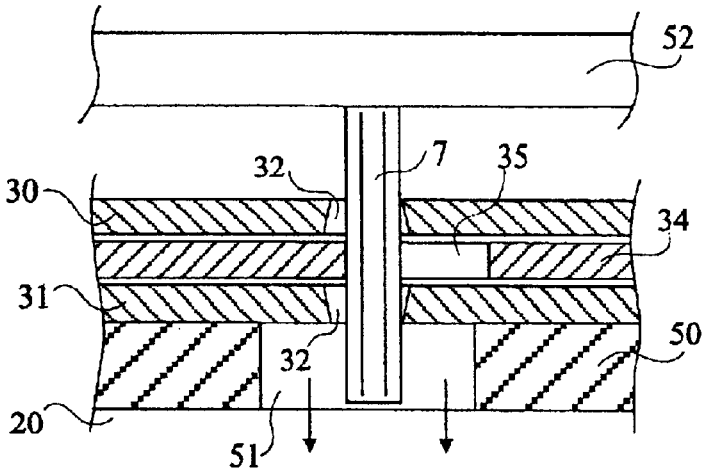

FIGS. 5A and 5B illustrate, in partial cross-section views, a mode of implementation of a spacer positioning method according to the present invention.

In FIG. 5A, a positioning tool 40 according to the present invention of the type of that illustrated in FIG. 4 is laid at a distance from a perforated plate (or porous support) 20 of a vacuum table (partially shown). The interval between positioning tool 40 and plate 20 is, preferably, defined by an array 50 of regularly-distributed bracings. For example, bracing array 50 may be formed in the form of a thick grid having holes 51 with a diameter much greater than the diameter of accessible holes 32 of positioning tool 40. However, it is not necessary for bracing array 50 to systematically include one bracing between two neighboring holes of positioning tool 40. The frequency of the bracings of array 50 depends, in practice, on the mechanical strength of tool 40. As an alternative, bracing array 50 may be provided to form one piece with one of the end grids of the tool (for example, grid 31) by being obtained, for example, by successive electroplating operations. This is not disturbing in this case since array 50 does not require the accuracy of grid 31.

The function of bracing array 50 is to enable spacers 7, which are introduced into aligned holes 32-35-32 of tool 40, to partially come out on either side of the tool. Conventionally, the placing of spacers 7 is performed by means of the vacuum table to aspirate a spacer 7 into each group of aligned holes 32-35-32 of grids 30, 34, and 31 of tool 40.

Preferably, the vertical position of spacers 7 is adjusted so that they all are at the same height with respect to one another by means of a plate 52, rectified in a perfectly planar way. Plate 52 is brought to face the free ends (opposite to the vacuum table) of spacers 7. Then, successive blowing and suction cycles are performed (illustrated by the arrows in he FIG. 5B) to push the spacers against element 52.

Finally, intermediary grid 34 of tool 40 is slid to block spacer 7. This sliding ensures that spacers 7 are positioned in a strictly vertical way, more specifically, strictly perpendicularly to the plane of positioning tool 40. Indeed, it is enough, to achieve this, for the alignment between holes 32 of end grids 30 and 31 to have been respected upon assembly by means of bracings 33.

Once grid 34 has been locked, spacers 7 are then maintained in their position without it being necessary to maintain vacuum.

It should be noted that a first optional blocking of the spacers may be performed before the step of adjustment of the vertical positions by means of plate 52. Such a blocking enables, for example, evacuation of the left over unpositioned spacers according to the method used to bring spacers 7 into holes 32-35-32 of tool 40.

According to another implementation mode, two different blowing and suction systems are provided at the level of the vacuum table. A first suction system is used to maintain tool 40 against the porous support of the vacuum table. A second system is used for blowing/suction for the spacer positioning in the holes of tool 40. The surface area of the first system may be much greater than that of the second system since it can occupy substantially the entire surface area (except for the holes) where there are no spacers. Thus, even when the second system is in blowing mode, the positioning tool is maintained in position by suction.

Figure 3A:
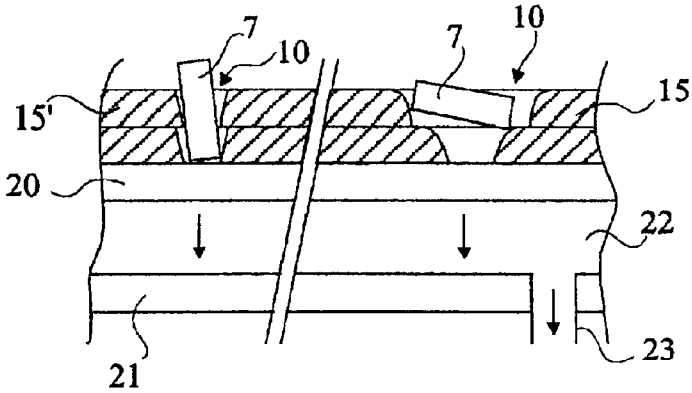
FIGS. 3A and 3B, previously described, illustrate by partial cross-section views an example of a conventional spacer positioning method.
Figure 3B:
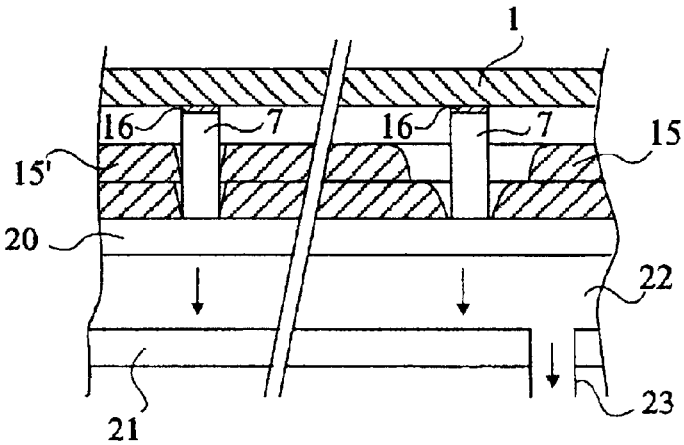

An advantage of the present invention is to enable handling of positioning tool 40 without it being necessary to maintain vacuum. Accordingly, the handling of the spacer positioning tools is made much easier and, in particular, without it being necessary to manipulate at the same time the plate with a rectified surface having been used for their vertical positioning. In a conventional method such as illustrated in FIGS. 3A and 3B, this particularly heavy rectified plate is directly formed by plate 20.

Another advantage of the present invention is that it is free of the surface evenness defects linked to the chemical etch process on the grids forming the positioning tool. Indeed, conversely to conventional tools and to conventional positioning methods, spacers 7 positioned by a tool according to the present invention partially come out, preferably, on either side, which enables perfect alignment, independent from the possible surface evenness defects of the actual tool.

Figure 6:
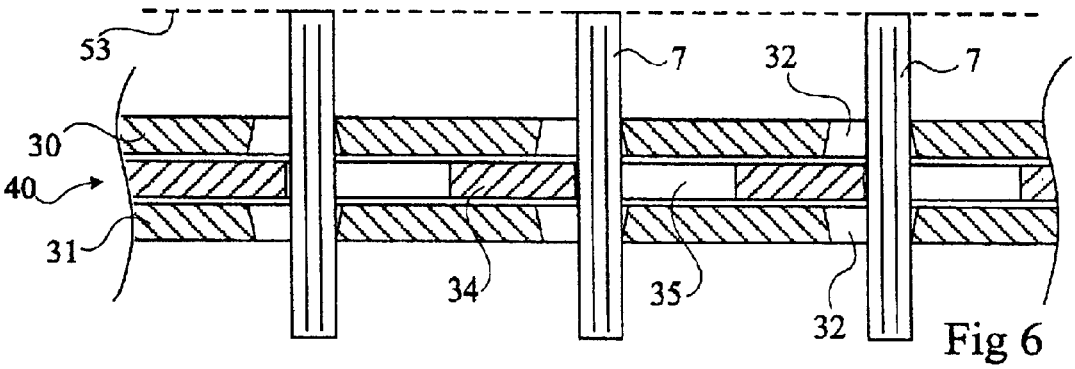
FIG. 6 shows in a very simplified partial cross-section view a positioning tool according to the first embodiment of the present invention in which spacers have been positioned.

FIG. 6 illustrates, in a partial cross-section view similar to that of FIG. 4, a positioning tool 40 according to the first aspect of the present invention, in which spacers 7 are maintained in place by grid 34 in shifted position with respect to grids 30 and 31. As illustrated by this drawing, the ends of spacers 7 can be perfectly aligned (dotted lines 53) on one side of the tool. Accordingly, the deposition of glue on these spacer ends and the placing of the spacers on the screen substrate is made considerably easier.

An advantage of the present invention is that it enables compensation of possible defects, even length defects, of the spacers by guaranteeing a fastening of all spacers on the first plate to be assembled of the screen. Afterwards, these spacers can then be fastened, for example glued, on the second plate, the glue thickness compensating for the length defect. Such is not the case in the conventional method where the spacer alignment is performed by their end opposite to that intended for receiving the glue. Accordingly, slightly shorter spacers risk not to receive any glue and not to be able to be fastened to the screen surface.

It should however be noted that the preferred use of a bracing array 50 to implement the spacer positioning and blocking method according to the present invention, illustrated by FIGS. 5A and 5B, is optional. The positioning tool of the present invention is perfectly compatible with the implementation of a conventional method of spacer fastening on a screen plate.

The use of thin grids to form grids 30 and 31 enables being at the level of maximum accuracy of the dimensions (of the positions of the different holes). For example, accuracies on the order of more or less 3 micrometers can be achieved. This accuracy conditions the accuracy with which the spacers are distributed on the screen plate between the pixels thereof and is to be compared with the tolerance of 10 micrometers or more in conventional methods.

It should be noted that although, in the above embodiment, the use of an intermediary grid that can be thicker than the external grids has been indicated, this is not a requirement. Indeed, it is no longer necessary according to the present invention to have a large thickness of the positioning tool to maintain the spacers in place. For example, a positioning tool according to the present invention may have a height representing at most one third of the spacer height. It should thus be noted that, conversely to conventional solutions that attempt solving the positioning problem by an increase in the thickness of the positioning tool (that is, of the number of superposed grids), the present invention conversely gets rid of the thickness requirement by a locking of the spacers in their position independently from the vacuum suction.

It should also be noted that, although the respective positions of the holes in the different grids of a tool according to the first aspect of the present invention must be accurate, the alignment of holes 35 of the intermediary grids with respect to those of the external grids needs not be performed accurately if holes 35 have a substantially greater diameter than holes 32. For example, for spacers having a diameter on the order of 75 micrometers, holes 32 having a diameter of approximately 120 micrometers may be provided for external grids 30 and 31, and holes 35 of approximately 150 micrometers or more may be provided for intermediary grid 34. In this case, a positioning to within 10 micrometers of intermediary grid 34 with respect to external grids 30 and 31 is highly sufficient. Now, such a positioning can be performed with the naked eye, 10 micrometers generally representing the eye's sensitivity threshold in a misalignment of the holes.

It should be noted that the spacers may have various cross-sectional shapes. In certain cases, it may be desired to use cross-shaped spacers to be able to adapt to the screen pixel pattern.

Figure 7:
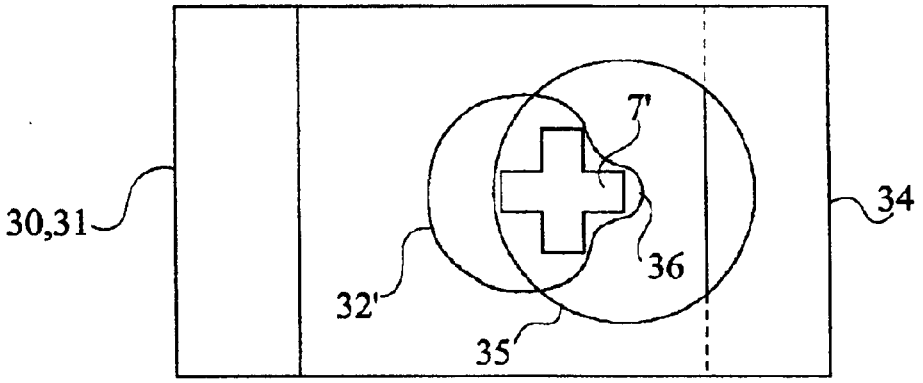
FIG. 7 shows in a very simplified partial top view a second embodiment of a spacer positioning tool according to the present invention.
Figure 8A:
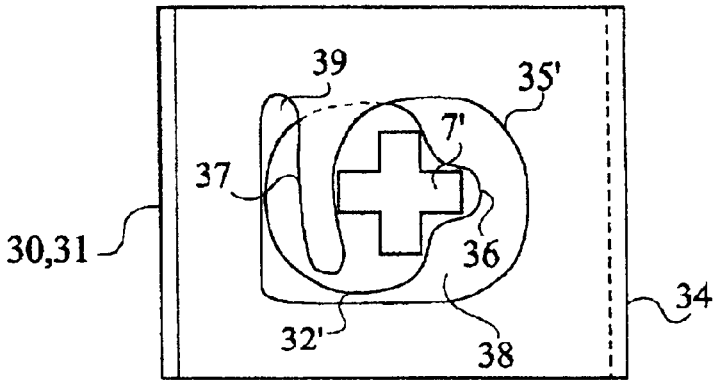
FIGS. 8A and 8B show in very simplified partial top views a third embodiment of a spacer positioning tool according to the present invention.
Figure 8B:
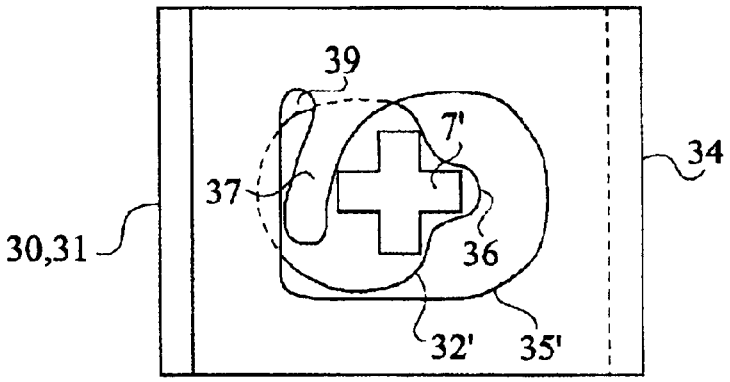

FIGS. 7, 8A, and 8B show a second and a third embodiments of a positioning tool according to the first aspect of the present invention, which are particularly well adapted to the positioning of spacers having a cross-shaped cross-section.

A common feature of these embodiments is that holes 32' formed in at least one of external grids 30 and 31 are provided with a notch 36 intended for receiving the end of one of arms 7' of a cross-shaped spacer. To simplify, a single hole has been shown in FIGS. 7, 8A and 8B.

In the second embodiment of FIG. 7, holes 35 of intermediary grid 34 remain circular with a diameter at least equal to the diameter of holes 32' taken without notches 36. The representation of FIG. 7 illustrates the position of holes 35 when grid 34 is misaligned with respect to grids 30 and 31 to block spacers 7 in the holes. In this position, the ends of an arm 7' of all the spacers are engaged in notches 36 of the corresponding holes 32'. Of course, all notches 36 of grids 30 and 31 will be directed in the same direction. All spacers 7 are thus positioned by being aligned in the same way. It is thus possible to position spacers in a cross so that they are placed between the active screen pixels.

It should be noted that, as previously indicated for the accuracy relative to the forming of holes 32', the accuracy relative to the forming of notches 36 is above all required in their positioning with respect to one another in grids 30 and 31. This accuracy is perfectly compatible with the accuracy obtained for grids of small thickness.

FIGS. 8A and 8B illustrate a third embodiment in which grids 30 and 31 are similar to the grids discussed in relation with FIG. 7, that is, holes 32' are each provided with a notch 36 for receiving one end of an arm 7' of a cross-shaped spacer. However, according to this embodiment, grid 34 is formed so that each hole 35' is associated with a tab 37 resiliently ductile in the plane of grid 34. For this purpose, and according to the embodiment illustrated in FIGS. 8A and 8B, holes 35' are formed by reproducing an approximately circular pattern as in the other embodiments. However, this circular pattern is connected to a substantially rectilinear port 39 having a length approximately corresponding to the circle diameter. A tab 37 is thus formed between circular opening 38 and rectilinear port 39. According to the dimensions of this tab and to the grid thickness, its resilience can be adjusted.

FIG. 8A shows the position of a tab 37 at rest, intermediary plate 34 having however started being displaced with respect to grids 30 and 31.

FIG. 8B shows the same structure, but with a greater displacement of intermediary grid 34 causing a deformation of tab 37 in the plane of the positioning tool.

An advantage of the embodiment illustrated in FIGS. 8A and 8B is that it enables compensating for possible tolerances in the cross-sectional dimensions of spacers 7 as well as for possible tolerances in the absolute position of the grid holes with respect to one another.

The forming of holes 35' with resilient tabs 37 is compatible with the conventional use of photolithography processes. It should however be ascertained that grid 34 is then no too thick to keep the resilient deformation. In particular, it can be considered that the minimum width of tab 37 corresponds to the thickness of grid 34. It should however be noted that, as previously indicated, a grid 34 of small thickness is not disturbing, provided that this grid enables, by sliding, blocking of the spacers in their position. As a specific example of implementation, tabs 37 approximately 700 micrometers long and having, in cross-section, a side approximately 30 micrometers long, may be provided. The choice of the dimensions of course depends on the spacer distribution pitch.

It should be noted that the embodiment with tabs of locking grid 34 may be implemented independently from the embodiment with notches 36 of external grids 30 and 31, that is, for spacers 7 having any cross-section.

The implementation of the present invention, according to its first aspect, is compatible with the use of materials conventionally used to form grids for positioning spacers in flat screens. Only for the embodiment with tabs will those skilled in the art possibly have to adapt the choice of the grid material to the desired resilient deformation. Materials having a small elastic modulus such as aluminum, zinc, silver, or gold, or materials with a more significant elastic modulus such as molybdenum or tungsten, with all the alloys and mainly the entire steel range which, with the appropriate thermal processings, can form spring leafs or resilient tabs, may be used.

Although reference has been made in the foregoing description to the use of a single intermediary grid, it is possible to provide two intermediary grids slidably assembled between the two external grids. In this case, different sliding directions may even be provided for the two intermediary grids.

Further, any adapted means may be used to have grid 34 slide between grids 30 and 31 and for, preferably, blocking it at least in the position where it locks the position of the spacers. The choice of this or these displacement and blocking means is within the abilities of those skilled in the art based on the functional indications given hereabove.

Other examples of implementation of a positioning tool according to the present invention will now be described. These examples of implementation provide substantially the same advantages as those described in relation with the preceding drawings. Further, they may be used in modes of implementation of the positioning method such as described hereabove and then also provide the corresponding advantages.

Figure 9A:
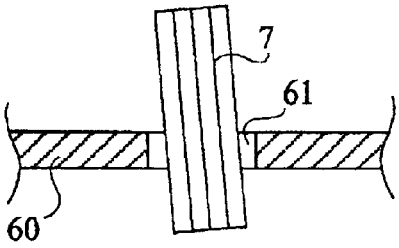
FIGS. 9A and 9B show in very simplified partial cross-section views a fourth embodiment of a positioning tool according to the present invention, respectively in a position of spacer introduction and in a blocking position.
Figure 9B:
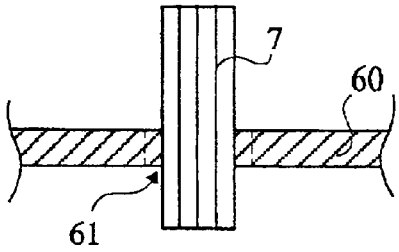

FIGS. 9A and 9B are partial cross-section views of a fourth embodiment of the present invention according to a second aspect which characterizes by the fact that the positioning tool includes a grid 60 ductile between a first position (FIG. 9A) of introduction of spacers 7 where the holes 61 that it includes have a relatively large diameter and a second position (FIG. 9B) of temporary blocking of the spacers where the diameter of the holes has narrowed with respect to the first position. According to this aspect of the present invention, grid 60 is relatively thin, that is, its thickness is compatible with the desired positioning accuracy when it is in blocking position. According to the embodiment of FIGS. 9A and 9B, the positioning tool includes a single grid 60, the deformation of which is performed in the plane of this grid, that is, the material forming it expands. This expansion may have different origins such as, for example, temperature (thermal expansion), a magnetic field (magnetostriction, piezomagnetism), an electric field (electrostriction, piezoelectricity), a chemical reaction. It should however be noted that this deformation must, according to the present invention, be reversible to free the spacers after fastening. The choice of the deformation initiator depends on the material forming grid 60 and is within the abilities of those skilled in the art. Solutions taking advantage of the deformation capacity of silicon or another material currently used in micro-actuators, subfractional horsepower motors or the like may for example be used.

Figure 10A:
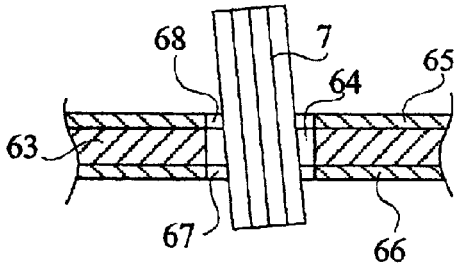
FIGS. 10A and 10B show, in very simplified partial cross-section views a fifth embodiment of a positioning tool according to the present invention, respectively in a position of spacer introduction and in a blocking position.
Figure 10B:
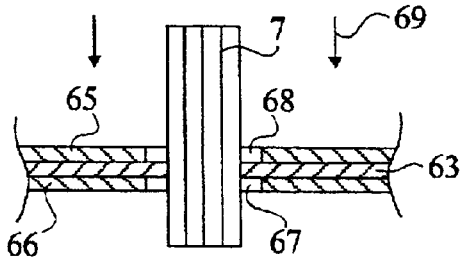

FIGS. 10A and 10B are partial cross-section views of a fifth embodiment of the present invention according to its second aspect. Here, a grid 63 has an approximately constant volume but a different thickness according to the positions of introduction (FIG. 10A) and blocking (FIG. 10B). The thickness variation translates as a reduction of the diameter of grid holes 64, which blocks spacers 7. In the embodiment shown in FIGS. 10A and 10B, grid 63 is framed by two non-ductile external grids 65 and 66 provided with holes, respectively 67 and 68. Grids 65 and 66 can then mechanically protect ductile grid 63, for example, to avoid a deformation by suction upon positioning of the spacers by means of a vacuum table. As an alternative, a single rigid grid associated with grid 63, or no rigid grid, may be provided.

As compared to the deformation initiators indicated in relation with FIGS. 9A and 9B, a mechanical pressure (arrows 69 in FIG. 10B), an acoustic pressure and the action of a fluid or a gas may here be added.

It should be noted that, as compared to the embodiment of FIGS. 4 to 6, no particular accuracy is desired for holes 67 and 68 since the blocking occurs by means of the sole grid 63. The only case where an alignment between these holes must be respected is if they are used for the spacer prepositioning (like holes 32 of FIGS. 4 and 5A), that is, if holes 64 of grid 63 are, in wide opening position, of a diameter greater than that of holes 67 and 68. This line of reasoning applies to all embodiments of the second aspect of the present invention using at least one rigid grid in association with the ductile grid.

Figure 11A:
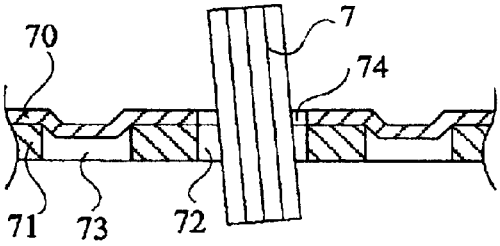
FIGS. 11A and 11B show, in very simplified partial cross-section views, a sixth embodiment of a positioning tool according to the present invention, respectively in a position of spacer introduction and in a blocking position.
Figure 11B:
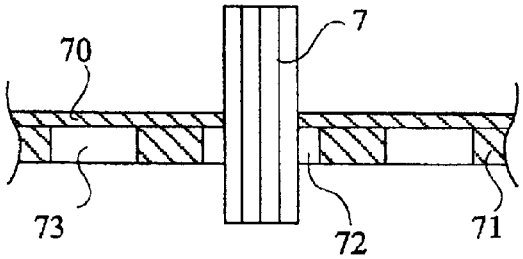

FIGS. 11A and 11B are partial cross-section views of a sixth embodiment of the present invention according to its second aspect. A ductile grid 70 rests upon a grid 71 defining, around holes 72 through which spacers 7 are to engage, rings 73 for absorbing the left over material of grid 71 when it is in a spacer introduction position (FIG. 11A). In this case, the developed surface of the material of grid 71 is approximately constant, its deformation resulting again in a narrowing of its holes 74 (FIG. 11B). Here again, a second non-ductile grid (not shown) covering grid 71 may be provided, and this second grid may however have no rings.

As compared to the deformation initiators indicated in relation with the preceding drawings, the suction by means of a vacuum table or the like may here be added, if the material of grid 70 is resiliently ductile towards a rest position such as in FIG. 11B, the stopping of the suction under rings 73 causing the reduction of the diameter of holes 74. In this case, either a single suction system, or a suction system under rings 73 and a blowing/suction system under holes 72, are used.

Figure 12A:
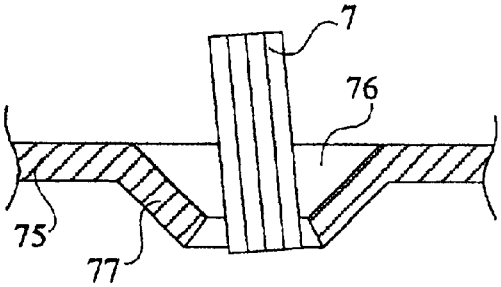
FIGS. 12A and 12B show, in very simplified partial cross-section views, a seventh embodiment of a positioning tool according to the present invention, respectively in a position of spacer introduction and in a blocking position.
Figure 12B:
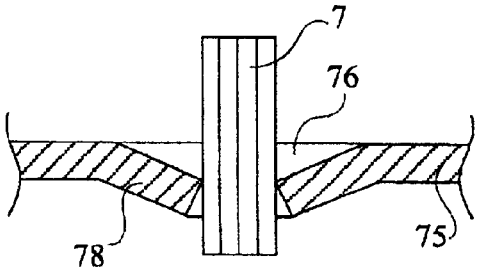

FIGS. 12A and 12B are partial cross-section views of a seventh embodiment of the present invention according to its second aspect. It shows, as in FIGS. 11A and 11B, a grid 75 of approximately constant developed surface. However, the deformation here is in a direction perpendicular to the grid plane, that is, each hole 76 has an annular flange 78 for clamping spacers 7 out of the plane of grid 75. The flanges open (FIG. 12A) or close (FIG. 12B) by one of the previously-mentioned means.

Figure 13A:
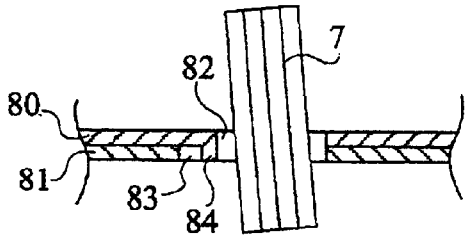
FIGS. 13A and 13B show, in very simplified partial cross-section views, an eighth embodiment of a positioning tool according to the present invention, respectively in a position of spacer introduction and in a blocking position.
Figure 13B:
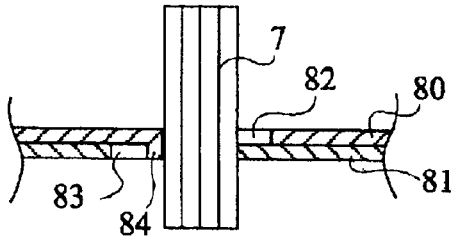

FIGS. 13A and 13B are partial cross-section views of an eighth embodiment of the present invention, using its first aspect again, that is, the sliding of one grid with respect to the other. According to this embodiment, only two grids 80 and 81, provided with holes, respectively 82 and 83, are used. To avoid for spacers 7 to be caught in pincers, which would result in inclining them, one of the two grids (f or example, upper grid 80) includes, at the periphery of one side of its holes 82, one or several beaks 84 directed towards the other grid. The function of beaks 84 is to form, on the opposite side of the holes where the spacers bear against the edges of grids 80 and 81 (FIG. 13B), a counterpart to the common thickness of grids 80 and 81 in the blocking position. Of course, to allow sliding, beak(s) 83 must not be present all around holes 82. According to an alternative not shown, two grids of substantially identical structure, which fit into each other, are provided, each grid including holes provided with beaks for covering the edge of the other grid and which face the beaks of this other grid.

Figure 14A:
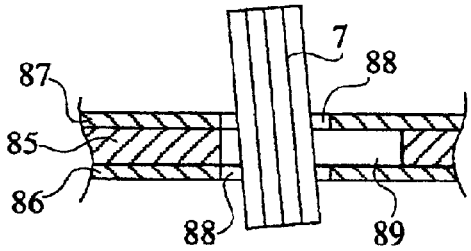
FIGS. 14A and 14B show, in very simplified partial cross-section views, a ninth embodiment of a positioning tool according to the present invention, respectively in a position of spacer introduction and in a blocking position.
Figure 14B:
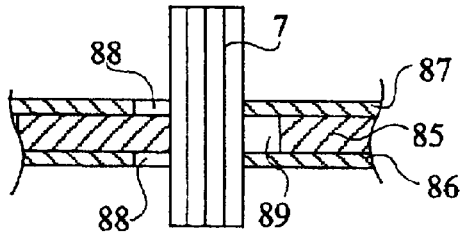

FIGS. 14A and 14B are partial cross-section views of a ninth embodiment of the present invention according to its second aspect. This embodiment uses a ductile grid 85 of the type of grid 60 of FIGS. 9A and 9B, but as an intermediary grid for clamping the spacers in a structure provided with two external grids 86 and 87. The positioning of spacers 7 is here ensured, as in the first aspect of the present invention, by holes 88 of the external grids, holes 89 of intermediary grid 85 having a minimum diameter greater than the diameter of spacers 7.

Figure 15A:
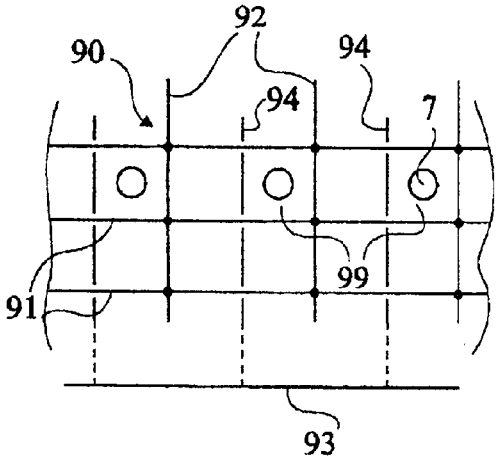
FIGS. 15A and 15B show, in very simplified partial top views, a tenth embodiment of a positioning tool according to the present invention, respectively in a position of spacer introduction and in a blocking position.
Figure 15B:
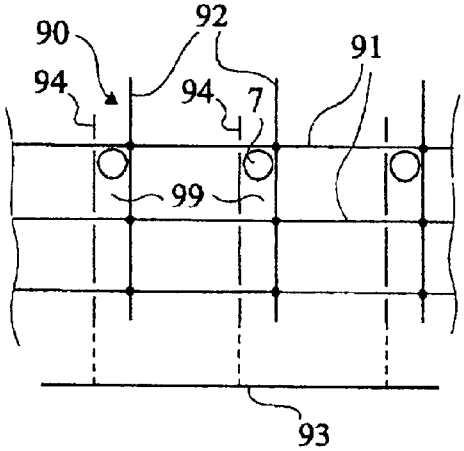

FIGS. 15A and 15B are partial top views of a tenth embodiment of the present invention according to a third aspect of the present invention which characterizes by the use of at least one very open-worked grid forming a netting of meshes having dimensions substantially greater than the spacer cross-section. In the embodiment of FIGS. 15A and 15B, a first netting 90 forms parallel horizontal lines 91 (in the orientation of the drawings) and vertical lines 92 having a pitch which is twice that of the horizontal lines. A second grid 93 has the shape of a comb, with teeth 94 (vertical in the orientation of the drawings) having a pitch approximately identical to the pitch of the vertical lines of netting 90. Comb 93 fits in between lines 92 and can slide horizontally between an open position (FIG. 15A) where the surface of the obtained meshes 99 enables introduction of spacers 7 and a blocking position (FIG. 15B) where the netting clamps the spacers. As a preferred alternative, netting 90 may be formed of two interleaved combs to enable sliding of the horizontal lines in the vertical direction and ensure a clamping of the spacers in both directions.

Figure 16A:
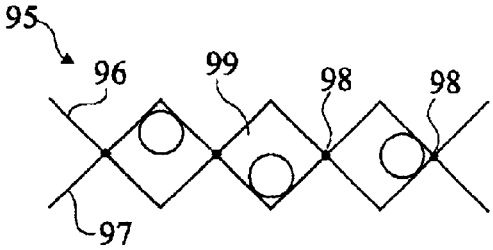
FIGS. 16A and 16B show, in very simplified partial top views, an eleventh embodiment of a positioning tool according to the present invention, respectively in a position of spacer introduction and in a blocking position.
Figure 16B:
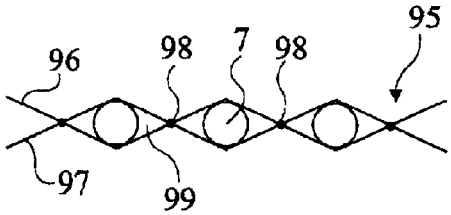

FIGS. 16A and 16B are partial top views of an eleventh embodiment of the present invention according to the third aspect of the present invention. A single grid 95 forming a netting with modifiable meshes is used. This grid includes successions of paired zigzag lines 96 and 97 (a single pair is shown in the drawings). Lines 96 and 97 are articulated at their intersections 98 and define meshes 99 of introduction of spacers 7. The blocking (FIG. 16B) occurs by slightly extending the structure, lines 96 and 97 being free at their ends. Due to articulations 98, the meshes elongate in the direction of the lines and narrow up in the perpendicular direction. In a structure such as illustrated in FIGS. 16A and 16B, the spacer distribution and position are defined by the meshes in their elongated position. Upon sizing of the meshes, it will be ascertained that the return to the introduction position (FIG. 16A) which shifts the meshes in the line direction is, after fastening of the spacers, possible without damaging this fastening.

Figure 17A:
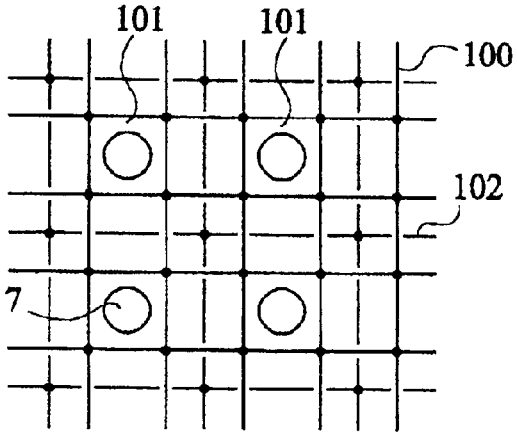
FIGS. 17A and 17B show, in very simplified partial top views, a twelfth embodiment of a positioning tool according to the present invention, respectively in a position of spacer introduction and in a blocking position.
Figure 17B:
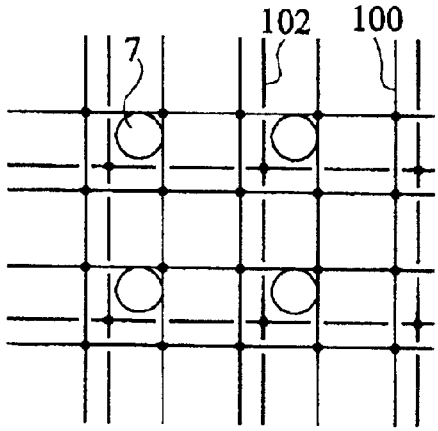

FIGS. 17A and 17B are partial top views of a twelfth embodiment of the present invention according to its third aspect. According to this embodiment, a first grid 100 having a constant pitch in both directions defines meshes 101 adapted to receiving a single spacer 7 in an alignment perpendicular to the grid plane. A second grid 102, superposed to grid 100, has a pitch which is constant in both directions, but corresponding to twice the pitch of the first grid. In introduction position (FIG. 17A), grid 102 is positioned to only free, for a spacer 7 to be housed therein, a single mesh 101 out of four of grid 100. The temporary blocking (FIG. 17B) is obtained by shifting grid 102 with respect to grid 100 in one of the two directions of the plane or in both directions according to the desired positioning. Such an embodiment may include a third grid, the second and third grids then being, preferably, mobile in perpendicular directions.

An advantage of using open-worked "nettings" described in the last three embodiments is that the obtaining of grids having a correct dimensional regularity costs little, even for large sizes. Such embodiments are appropriate, in particular, when a large number of spacers are desired to be positioned.

Of course, the present invention is likely to have various alterations, modifications, and improvements which will readily occur to those skilled in the art. In particular, the adaptation of the dimensions of the positioning tool according to the application is within the abilities of those skilled in the art based on the functional indications given hereabove. Further, although, for simplification, reference has been made to diameters, it should be noted that the present invention may be implemented with holes having any shape, the word hole encompassing, in the sense of the present invention, any meshes and openings, the dimensional ratios of which are deduced from the indications given in relation with the diameters and from the shape and size of the spacers.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A tool for positioning spacers (7) on a first plate (1) intended for being maintained at a distance from a second plate (4) by said spacers, said tool including openings for receiving said spacers, wherein said openings (32-35-32) 32'-35-32, 32'-35'-32', 61, 67-64-68, 72-74, 76, 83-82, 88-89-88, 99) are of variable size between a first position of introduction of the spacers and a second position of mechanical blocking of the spacers.

2. The tool of claim 1, wherein the general thickness of the positioning tool is smaller than one third of the height of the spacers (7).

3. The tool of claim 1, wherein said openings (32-35-32, 32'-35-32, 32'-35-32', 61, 67-64-68, 72-74, 76, 83-32, 88-89-88, 99) have, in the first position, a diameter greater than the diameter in which the section of a spacer (7) is inscribed, smaller than the height of the spacer and such that two spacers cannot be introduced therein at the same time.

4. The tool of claim 1, including at least two grids (31, 34, 30; 80, 81; 90, 93) in planes parallel to each other, at least one first grid (34; 80; 93) being assembled to slide parallel to a second grid (31, 33; 81; 90).

5. The tool of claim 4, including two external grids (30, 31) attached in planes parallel to each other to define the distribution of the spacers (7), and at least one grid (34) for locking the spacers in their position, slidably assembled between said two external grids.

6. The tool of claim 5, wherein said two external grids (30, 31) include holes (32, 32') having a diameter substantially greater than the diameter in which the section of the spacers to be positioned (7) is inscribed.

7. The tool of claim 6, wherein said two external grids (30, 31) include holes (32, 32') of said diameter.

8. The tool of claim 7, wherein said locking grid (34) includes holes (35, 35') having a diameter at least equal to the diameter of the holes (32, 32') of the external grids (30, 31).

9. The tool of claim 5, wherein the thickness of the external grids (30, 31) is chosen according to the maximum tolerance desired for the positioning of the spacers (7).

10. The tool of claim 9, wherein the thickness of the external grids (30, 31) is smaller than 50 micrometers.

11. The tool of claim 5, wherein the holes (35') of at least one locking grid are each associated with a resilient tab (37) for blocking a spacer (7) in its position.

12. The tool of claim 5, wherein the holes (32') of at least one of the external grids (30, 31) each include a notch (36) for receiving one end of an arm (7') of a spacer, said spacers (7) having, in cross-section, the shape of a cross.

13. The tool of claim 1, including at least one ductile grid (60, 63, 70, 75, 85, 95) provided with holes (61, 64, 74, 76, 89, 99) at least at the locations of the spacers (7), a change of size of said holes being caused by a controlled reversible deformation of this grid.

14. The tool of claim 13, including at least one rigid grid (65, 66; 71; 86; 87) parallel to the ductile grid and provided with holes (67, 68; 72; 88) approximately aligned with those (64; 74; 89) of the ductile grid (63, 70, 85) when said grid is in a fist position.

15. A method of positioning spacers in a tool including openings for receiving said spacers, wherein said openings (32-35-32, 32'-35-32, 32'-35'-32', 61, 67-64-68, 72–74, 76, 83-82, 88-89-88, 99) are of variable size between a first position of introduction of the spacers and a second position of mechanical blocking of the spacers, said method comprising:

placing a spacer (7) in each opening (32-35-32, 32'-35-32, 32'-35'-32', 61, 67-64-68, 72-74, 76, 83-82, 88-89-88, 99) of the positioning tool in a first position using a vacuum table (20); and performing successive suction and blowing cycles, by applying a free end of the spacers against an alignment plate (52), before their locking in their position by narrowing of the openings.

* * * * *